US005173255A

United States Patent [19]

Ross et al.

[11] Patent Number: 5,173,255

[45] Date of Patent: Dec. 22, 1992

[54] CAST COLUMNAR GRAIN HOLLOW NICKEL BASE ALLOY ARTICLES AND ALLOY AND HEAT TREATMENT FOR MAKING

[75] Inventors: Earl W. Ross, Cincinnati, Ohio; Kevin S. O'Hara, Boxford, Mass.

[73] Assignee: General Electric Company, Cincinnati, Ohio

[21] Appl. No.: 686,882

[22] Filed: Apr. 17, 1991

Related U.S. Application Data

[63] Continuation of Ser. No. 253,109, Oct. 3, 1988, abandoned.

[51] Int. Cl.[5] ..... C22C 19/05

[52] U.S. Cl. ..... 420/445; 420/448; 148/675; 148/410

[58] Field of Search ..... 420/443, 448, 445, 3; 148/404, 410, 428, 162, 675

[56] References Cited

U.S. PATENT DOCUMENTS 3,260,505 7/1966 Ver Snyder ..... 253/77
3,494,709 2/1970 Piercey ..... 416/232
4,169,742 10/1979 Wukusick et al. ..... 148/32.5
5,068,084 11/1991 Cetel et al. ..... 420/443

FOREIGN PATENT DOCUMENTS 0032812 7/1981 European Pat. Off. .
0155827 9/1985 European Pat. Off. .
0194925 9/1986 European Pat. Off. .
0246082 11/1987 European Pat. Off. .
2243270 4/1975 France .

*Primary Examiner*—R. Dean
*Assistant Examiner*—Margery S. Phipps
*Attorney, Agent, or Firm*—Jerome C. Squillaro; Carmen Santa Maria

[57] ABSTRACT

One form of an improved cast, hollow, columnar grain nickel base alloy article is provided with outstanding elevated temperature stability as represented by oxidation resistance, an improved combination of longitudinal and transverse stress rupture properties, and a thin wall of less than about 0.035 inch, substantially free of cracks. Described is a heat treatment in combination with an alloy for providing such an article.

11 Claims, 1 Drawing Sheet

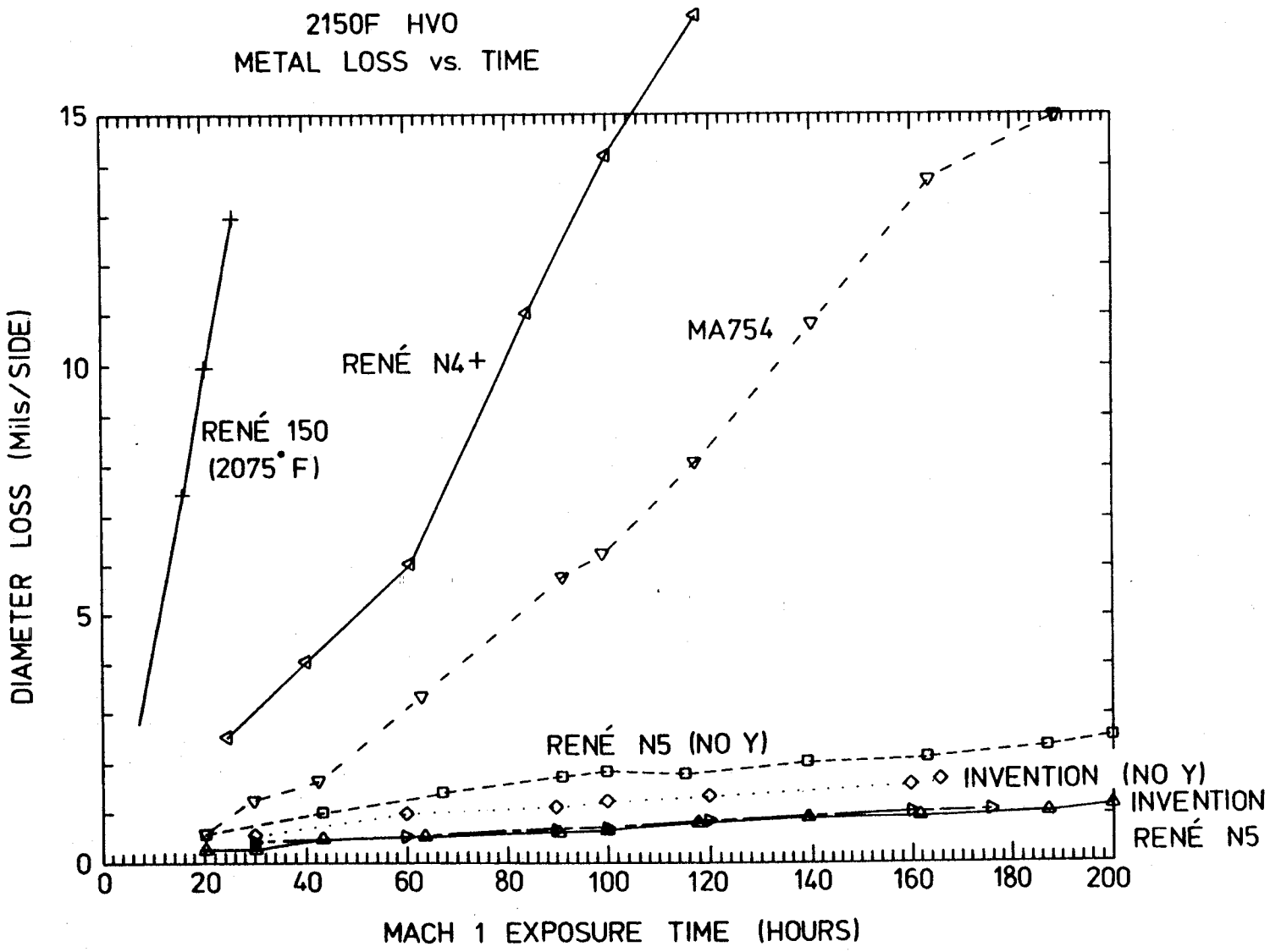
2150F HVO
METAL LOSS vs. TIME
MA754
RENÉ N4+
RENÉ 150
(2075°F)
RENÉ N5 (NO Y)
INVENTION (NO Y)
INVENTION
RENÉ N5
DIAMETER LOSS (Mils/SIDE)
MACH 1 EXPOSURE TIME (HOURS)
0
5
10
15
0
20
40
60
80
100
120
140
160
180
200

CAST COLUMNAR GRAIN HOLLOW NICKEL BASE ALLOY ARTICLES AND ALLOY AND HEAT TREATMENT FOR MAKING

This application is a continuation of application Ser. No. 07/253,109 filed Oct. 3, 1988 now abandoned.

This invention relates to cast directionally solidified columnar grain nickel base alloy articles and, more particularly, to such an article of outstanding elevated temperature surface stability as represented by oxidation resistance, particularly in thin walled hollow articles, and to the alloy and heat treatment for making such article.

BACKGROUND OF THE INVENTION

A significant amount of the published and well known casting technology relating to high temperature operating articles, for example turbine blades for gas turbine engines, has centered about improvement of certain properties through elimination of some or all of the grain boundaries in the final article's microstructure. In general, such structures have been generated by the well known precision casting techniques of solidifying a molten metal directionally (directional solidification) to cause the solidifying crystals or grains to be elongated. If only one grain is allowed to grow in the article during solidification, for example, through choking out others or using a seed crystal, an article of a single crystal and substantially no grain boundaries results. However, if multiple grains are allowed to solidify at an area of a casting mold and allowed to grow generally in a single direction in which heat is withdrawn from molten metal in a casting mold, multiple elongated or columnar grains exist in the solidified casting. Such a structure sometimes herein is called "DS multigrain" in connection with a cast article. The direction of elongation is called the longitudinal direction; the direction generally normal to the longitudinal direction is called the transverse direction.

Because the grain boundaries in such an article are substantially all longitudinal grain boundaries, it is important in an article casting that longitudinal mechanical properties, such as stress rupture life and ductility, be very good, along with good transverse mechanical properties and good alloy surface stability. With this property balance in the article, the article alloy must be capable of being cast and directionally solidified in complex shapes and generally with complex internal cavities and relatively thin walls without cracking. So called "thin-wall" hollow castings have presented difficult quality problems to article casters using the well known "lost wax" type of precision casting methods with alloys designed for improved properties: though the alloy properties are good and within desired limits, thin wall castings, for example with a wall less than about 0.035 inch thick, generally cracked during multicolumnar grain directional solidification.

SUMMARY OF THE INVENTION

Briefly, in one form, the present invention provides an improved cast columnar grain nickel base alloy article characterized by outstanding elevated temperature surface stability for a directionally solidified article, resulting from an alloy specification enhanced, in one form, by heat treatment and by an improved combination and balance between longitudinal and transverse stress rupture properties. In one form, the article has at least one internal cavity and includes an integral cast wall substantially free of a major crack, the wall having a thickness of less than about 0.035 inch.

In respect of the alloy associated with the present invention, a particular combination of the elemental addition of C, Hf, Co and Ta, and the intentional limitation of the elements V, Zr, and Ti, provides outstanding elevated temperature oxidation resistance, good castability, and resistance to grain boundary and fatigue cracking in a Ni base alloy which also includes Cr, Mo, W, Al, Re and B, and which allows optional amounts of Cb and Y.

In one form, the alloy includes essentially, in percentages by weight, the combination of 0.1–0.15 C, 0.3–2 Hf, 11–14 Co, 5–9 Ta, less than 0.05 Zr and the substantial absence of V and Ti at no more than about 1 each, to provide the alloy with the capability of being made into a DS multigrain article through good castability and resistance to grain boundary and fatigue cracking, along with outstanding oxidation resistance. The remainder of the alloy is 5–10 Cr, 0.5–3 Mo, 4–7 W, 5–7 Al, 1.5–4 Re, 0.005–0.03 B, up to 1.5 Cb, up to 0.5 Y and the balance Ni and incidental impurities.

Another form of the present invention associated with such alloy is a heat treatment involved in the method for making the article. Such heat treatment comprises a combination of at least three progressive heating steps including a solutioning step, a preliminary, first aging step and a second aging step, to improve stress rupture properties of the article.

BRIEF DESCRIPTION OF THE DRAWING

The sde drawing figure is a graphical comparison of oxidation resistance of the alloy associated with the present invention with other alloys.

DESCRIPTION OF THE PREFERRED EMBODIMENTS

The nickel base alloy associated with the present invention is particularly characterized by the relatively high C content in combination with a relatively large amount of Hf and additions of Co and Ta. This, along with the intentional control and limitation of the elements V, Zr and Ti, enabled the total alloy to have, for a DS structure, outstanding oxidation resistance and the good DS castability and resistance to grain boundary and fatigue cracking to the point at which thin walls of less than 0.035 inch can be DS cast with elongated grains substantially crack free. Other elements in the alloy, contributing to its unique mechanical properties and surface stability, in a nickel base, are Cr, Mo, W, Al, Re, B and optional, limited amounts of Cb and Y. The resultant article, with an unusual, unique combination of mechanical properties and surface stability, is particularly useful in making hollow, air cooled, high temperature operating components such as blading members (blades and vanes) of the type used in the strenuous environment of the turbine section of gas turbine engines. In rotating turbine blades which are subject to high stress as well as high temperature oxidation and hot corrosion, the crack free condition of thin walls associated with internal cooling passages, is essential to safe, efficient engine operation.

A measure of the castability and crack resistance of high temperature directionally solidified columnar grained nickel base superalloys is the castability test and rating scale reported in U.S. Pat. No. 4,169,742 Wukusick et al, issued Oct. 2, 1979, beginning in column 2 at line 41 and continuing into column 3. The disclosure of such patent is hereby incorporated herein by reference. The rating is repeated here in Table I.

TABLE I

| CASTABILITY RATINGS | |
|---|---|
| A | No cracks |
| B | Minor crack at tip, less than ½" long or in starter zone |
| C | One major crack, greater than ½" long |
| D | Two or three cracks |
| E | Several cracks, more than 3 and less than 8 |
| F | Many cracks - most grain boundaries |

A selection of nickel base superalloys sometimes used or designed for use in gas turbine engine turbine components is presented in the following Table II along with a form of the particular alloy associated with the present invention. The alloy identified as Rene' N5, designed for use in making single crystal alloy articles, is described in currently pending U.S. patent application Ser. No. 790,439—Wukusick et al., filed Oct. 15, 1985; the alloy identified as Rene' 150, designed for use as a DS columnar grain article, is described in the above incorporated U.S. Pat. No. 4,169,742—Wukusick, et al. The disclosure of such copending application assigned to the assignee of this invention, also is hereby incorporated herein by reference. Also included in Table II are the castability ratings of such alloys.

An evaluation of varying Hf, Co and B in the alloy identified in Table II as Rene' N5 was conducted to improve castability. Results of such evaluation are shown in Table III.

TABLE II

NOMINAL ALLOY COMPOSITIONS
(Wt %, balance Ni and incidental impurities)

| ALLOY | C | Hf | Co | Ta | V | Zr | Cr | Mo | W | Ti | Al | Re | B | Cb | Y | $O_2$ | CASTABILITY RATING |
|---|---|---|---|---|---|---|---|---|---|---|---|---|---|---|---|---|---|
| Rene' N4+ | .05 | .15 | 7.5 | 4.8 | | | 9.8 | 1.5 | 6 | 3.5 | 4.2 | | .004 | 0.5 | | | N.A. (a) |
| Rene' N5 | .05 | .15 | 7.5 | 6.5 | | | 7 | 1.5 | 5 | | 6.2 | 3 | .004 | | 0.1 | | N.A. (a) |
| Rene' 150 | .05 | 1.5 | 12 | 6 | 2.2 | | 5 | 1 | 5 | | 5.5 | 3 | .015 | | | | A |
| Rene' 80H | .17 | .75 | 9.5 | | | .01 | 14 | 4 | 4 | 4.8 | 3 | | .015 | | | | A |
| No Coat | .05 | .15 | 7.5 | 5 | | | 9.5 | 1.5 | 6 | 1:5 | 5.6 | | .004 | | .01 | | C-F |
| "MA 754" (b) | | | | | | | 21 | | | | | | | | 0.6 | 0.4 | N.A. (b) |
| INVENTION | .12 | 1.5 | 12 | 6.35 | | | 6.8 | 1.5 | 4.9 | | 6.15 | 2.8 | .015 | | | | A |

(a) N.A. - Not applicable - single crystal
(b) wrought

TABLE III

DS CASTABILITY TESTS OF RENE' N5 VARIATIONS
(Based on Rene' N5 Alloy Composition, Table II)

| | ELEMENTS ADDED TO BASE (Nominal Weight Percent) | | | | | | |
|---|---|---|---|---|---|---|---|
| | Hf | | Co | | B | | |
| TEST | Added | Total | Added | Total | Added | Total | CASTABILITY RATING |
| 87-1 | 1.5 | 1.6 | 0 | 7.5 | 0 | .004 | D-F |
| 87-2 | 1.5 | 1.6 | 3 | 10.5 | 0 | .004 | A |
| 87-3 | 1.5 | 1.6 | 0 | 7.5 | 0.01 | .014 | D-E |
| 87-4 | 0.5 | 0.6 | 3 | 10.5 | 0 | .004 | A |
| 87-5 | 1.0 | 1.1 | 3 | 10.5 | 0 | .004 | A |
| 42-1 | 0.9 | 1.0 | 3 | 10.5 | 0 | .004 | A |
| 42-2 | 0.4 | 0.5 | 3 | 10.5 | 0 | .004 | B |
| 42-3 | 0.6 | 0.75 | 3 | 10.5 | 0 | .004 | A |
| 42-4 | 0.4 | 0.5 | 4.5 | 12.0 | 0 | .004 | A |
| 42-5 | 0.6 | 0.75 | 1.5 | 9.0 | 0 | .004 | A |
| 42-6 | 0.2 | 0.3 | 4.5 | 12.0 | 0 | .004 | A |
| 85-1 | 0.4 | 0.5 | 0 | 7.5 | 0 | .004 | D |
| 85-2 | 0.3 | 0.45 | 1.5 | 9.0 | 0 | .004 | C |
| 85-3 | 0.2 | 0.3 | 3 | 10.5 | 0 | .004 | D |
| 85-4 | 0.3 | 0.4 | 3 | 10.5 | 0 | .004 | D |
| 85-5 | 0.4 | 0.5 | 3 | 10.5 | 0 | .004 | A |
| 85-6 | 0.6 | 0.75 | 3 | 10.5 | 0 | .004 | B |
| 85-7 | 0 | 0.15 | 4.5 | 12.0 | 0 | .004 | D |
| 85-8 | 0.2 | 0.3 | 4.5 | 12.0 | 0 | .004 | A |
| 85-9 | 0.3 | 0.4 | 4.5 | 12.0 | 0 | .004 | A |

The data of Table III show primarily the benefit and criticality of including Co at a level greater than 7.5 wt % (for example about 10 wt %) up to about 12 wt %, in combination with Hf in the range of about 0.3–1.6 wt %. However, even with such improved castability, the alloy modification of Rene' N5 alloy had reduced longitudinal stress rupture strength due to dilution of the hardening elements from the addition of more Co to the Rene' N5 alloy base chemistry of Table II above, at a C level of about 0.05 wt %. With the nominal 3% additional Co to the Rene' N5 Alloy composition (to make it a total of 10.5% Co) and nominally 1% Hf, longitudinal stress rupture life was about 65% of Rene' N5 alloy; with nominally 4.5% additional Co (to make it a total of 12% Co) and at 0.5% Hf, longitudinal stress rupture life was 30% of Rene' N5 Alloy. This is indicative of one critical balance of elements used in the present invention, with an alloy composition including C in the range of about 0.1–0.15 wt % along with Co in the range of 11–14 wt % and 0.3–2 wt % Hf.

In respect to the balance between castability, and grain boundary and fatigue cracking, it has been recognized that too little Co results in loss of castability and grain boundary strenghening, whereas above about 14 wt % Co can dilute the effect of certain alloy strengthening elements. The element Hf, if too low, such as below about 0.3 wt %, increases the tendency toward grain boundary cracking in DS casting and in use; and if too high, such as above 2 wt %, Hf can result in problems relating to casting reactivity and incipient melting during heat treatment. Too much Ta and Al can affect castability by being too strong and can cause grain boundary cracking. Also it can form Topologically Close Packed (TCP) phases. Therefore, the Ta content is maintained preferably in the range of about 6–7 wt % and the Al preferably is 5.5–6.5 wt % in the practice of this invention. As is known in the art, small amounts of Cb may be substituted for Ta.

In the evaluation of some of the alloys of Table II, it was recognized that vanadium can detract from the surface stability, i.e., hot corrosion and oxidation resistance; Zr can increase crackability; and Ti can seriously reduce oxidation resistance. Therefore, these elements have been controlled and limited to the ranges in weight percent of less than about 1 V, 0.05 Zr and 1.5 Ti, preferably less than 0.1 V, 0.03 Zr and 0.02 Ti. While yttrium is helpful in improving oxidation resistance, it can cause grain boundary weakening; thus, it is limited to amounts less than 0.1% in the alloys of the invention. Cr is included primarily for its contribution to oxidation and hot corrosion resistance; Mo, W and Re primarily for matrix strengthening and B to enhance grain boundary strength.

Although the castability of such alloys as Rene' 150 were very good and within the acceptable range for thin wall castings, their surface stabilities were unacceptable for certain high temperature applications under strenuous environments. A comparison of the elevated temperature surface stability of Rene' 150 alloy and the alloy of the present invention has shown that during 100 hours exposure to Mach 1 air, Rene' 150 alloy at 2075° F. lost 50–65 mils of metal per specimen side, whereas the alloy of the present invention, in the form shown in Table II, at a higher temperature of 2150° F. and a longer exposure time of 150 hours lost only 1.5 mils per specimen side, i.e. less than about 5 mils per side according to this invention. In another test, for additional comparison, Rene' 150 alloy at 2075° F. in Mach 1 airflow lost 40 mils per specimen side after 82 hours.

One nickel base alloy considered to have outstanding elevated temperature oxidation resistance is the alloy sold under the trademark "MA 754" and having the composition alloy, identified in Table II. Such alloy is a wrought rather than cast alloy but is included here for further comparison with the oxidation resistance of the present invention. After exposure of a specimen of the alloy sold under the trademark "MA 754" at Mach 1 airflow and 2150° F., loss of 10 mils per specimen side occurred after 140 hours exposure. Confirming the outstanding elevated temperature oxidation resistance of the present invention were tests conducted on specimens from a 3000 pound heat of the alloy of the present invention. After 170 hours exposure at 2150° F. and Mach 1 airflow, a specimen showed a metal loss of only 1.6 mils per side; after 176 hours at those conditions, a loss of only 2 mils of metal per side was observed.

Another form of a comparison of this outstanding elevated temperature surface stability, as represented by oxidation resistance, of the present invention with other alloys is shown in the graphical presentation of the drawing. That comparison shows surface loss of a specimen in terms of hours of exposure in high velocity air (HVO) moving at a speed of Mach 1 at 2150° F. The Mach 1 oxidation test specimens referred to herein were 0.23" diameter by 3.5" long. Twenty-four specimens were mounted on a round metal plate and tested in a furnace which is heated by aircraft jet fuel. The test specimens were examined about every 24 hours. As can be seen, the present invention provides a cast article with remarkable surface stability.

As was stated above, an important characteristic of the present invention is its improved longitudinal stress rupture strength and improved balance between longitudinal and transverse stress rupture properties along with the outstanding surface stability discussed above. It exhibits, in a DS columnar grain article, the good stress rupture strength of Rene' 150 alloy and outstanding oxidation resistance of the single crystal article of the Rene' N5 composition in Table II above. The following Table IV compares certain stress rupture properties:

TABLE IV

| TEMP (°F.) | STRESS (ksi) | LONGITUDINAL STRESS RUPTURE DATA (uncoated, 0.160 diameter bars) ALLOY/RUPTURE LIFE (hours) INVENTION(DS) | RENE' 150(DS) | RENE' N4(a) |
|---|---|---|---|---|
| 1800 | 40 | 40–70 | 40–70 | 60 |
| 1600 | 80 | 45–100 | 50–90 | 65 |

(a) Single crystal, diffusion aluminide coated.

For the alloy of the present invention, the transverse stress rupture strength at 1800° F. and 32,000 psi (32 ksi) nominally was in the range of about 80–120 hours, as shown in Table V below.

During the evaluation of the present invention, several heat treatments were studied. In one series of heat treatment tests, the alloy associated with the present invention and nominally described in Table II was DS cast into ¼" thick ×2" wide×44" long columnar grain slabs from which standard stress rupture specimens were machined after heat treatment of the slabs. In previous evaluations, for example with Rene' 150 alloy columnar grain articles, only partial solutioning was necessary to develop desired properties and full solutioning (90–95%) seriously reduced transverse stress rupture properties. However, it was found that the present invention requires substantially full solution heat treatment (at least 90% solutioning of the gamma—gamma prime eutectic and coarse secondary gamma prime with no more than about 4% incipient melting) in order to develop desired properties. In addition to the initial substantially full solutioning, a preferred form of the heat treatment of the present invention includes an additional progressive combination of aging steps: a primary, first aging to improve ductility and transverse stress rupture properties, and two additional aging treatments at temperatures consecutively lower than that of the primary age to further optimize the gamma prime precipitate.

An outline of a series of heat treatments evaluated, along with resulting stress rupture strength, is shown in the following Table V. The heat treatments, identified as A, B, C and D, summarize the heating steps, first with a solution temperature in the range of 2300–2335 F. for 2 hours. This is followed by a progressive combination and series of aging steps identified in a manner widely used and understood in the metallurgical art. The solution and aging steps were conducted in a non-oxidizing atmosphere: vacuum, argon or helium. Cooling below 1200° F., conducted between aging steps, need not be conducted in such an atmosphere. Of the heat treatments evaluated, heat treatment D, involving a unique relatively slow cooling step from the first aging to the temperature at which the second aging temperature was to be conducted, resulted in the best combination of properties.

TABLE V

INVENTION ALLOY RUPTURE TESTS FROM ¼" THICK SLABS vs HEAT TREATMENT A TO D (Fast Cools Unless Otherwise Noted)

| Direction* | Temp/°F. | Stress/KSI | Life/Hours | EL/% | RA/% |
|---|---|---|---|---|---|
| | A - 2300F/2 Hours + 1975F/4 Hours + 1650/4 Hours | | | | |
| L | 1600 | 65 | 319.1 | 21.5 | 37.0 |
| L | 1600 | 75 | 47.5 | 11.6 | 27.7 |
| L | 1800 | 35 | 73.4 | 16.6 | 39.4 |
| L | 1800 | 38.5 | 49.9 | 18.8 | 41.6 |
| L | 1800 | 40 | 38.3 | 22.3 | 38.8 |
| L | 2000 | 15 | 97.0 | 11.5 | 45.9 |
| T | 1600 | 65 | 49.9 | 1.8 | 1.3 |
| T | 1800 | 32 | 87.0 | 4.0 | 3.8 |
| T | 2000 | 10 | 85.5 | 1.4 | 0.6 |
| | B - 2335F/2 Hours + 1975F/4 Hours + 1650F/4 Hours | | | | |
| L | 1600 | 75 | 113.5 | 13.0 | 27.9 |
| L | 1800 | 40 | 45.9 | 22.9 | 51.3 |
| L | 2000 | 15 | 161.0 | 13.3 | 45.9 |
| T | 1600 | 65 | 50.4 | 3.5 | 3.8 |
| T | 1800 | 30 | 150.1 | 4.3 | 3.7 |
| T | 1800 | 32 | 4.6,72.2 | 1.6,1.5 | 1.3,1.3 |
| | C - 2335F/2 Hours + 2050F/4 Hours + 1975F/4 Hours + 1650F/4 Hours | | | | |
| L | 1600 | 75 | 121.4 | 14.5 | 28.4 |
| L | 1800 | 40 | 56.9 | 21.0 | 46.2 |
| L | 2000 | 15 | 293.4 | 21.4 | 63.0 |
| T | 1600 | 65 | 2.0 | 0.8 | 0.0 |
| T | 1800 | 32 | 107.2 | 2.7 | 2.5 |
| T | 2000 | 10 | 72.3 | 2.0 | 0.6 |
| | D - 2335F/2 Hours + 2050F/4 Hours, One Hour Cool to 1975F + 1975F/4 Hours + 1650F/4 Hours | | | | |
| L | 1600 | 80 | 99.2,81.9 | 13.1,12.0 | 25.3,22.8 |
| L | 1800 | 40 | 81.7 | 16.5 | 42.5 |
| L | 1800 | 30 | 376.2 | 21.4 | 52.2 |
| L | 2000 | 17.5 | 61.5,67.6 | 15.8,12.8 | 50.4,32.0 |
| T | 1600 | 65 | 27.2,129.4,117.3 | 0.6,2.3,2.4 | 1.2,2.5,6.7 |
| T | 1800 | 30 | 189.1 | 3.4 | 5.6 |
| T | 1800 | 32 | 75.1,100.4,159.1 | 2.4,2.8,4.0 | 2.5,1.2,3.1 |
| T | 2000 | 10 | 22.6 | 2.5 | 1.9 |

*Longitudinal — L, Transverse — T

In the heat treatment of the present invention, a substantially full solutioning step is included. This is in contrast with the partial solutioning commonly used with such DS articles made from alloys from Table II such as Rene' 150, certain properties of which are affected detrimentally by a full solution heat treatment. In this invention, solutioning of at least about 90% of the gamma—gamma prime eutectic and coarse secondary gamma prime and with less than about 4% incipient melting is important because the stress rupture life is increased with increased solutioning of the gamma prime eutectic and coarse secondary gamma prime. The following Table VI compares amount of solutioning and stress rupture life for the alloy associated with the present invention.

TABLE VI

Effect of Solutioning on Stress Rupture Life

| % Unsolutioned | 1800° F. Stress Rupture Life |
|---|---|
| 20 | x |
| 10–15 | 2x |
| 0–5 | 3x |

After solutioning, it is preferred that cooling, for example to a temperature in the range of about 2025°–2075° F., be at a rate of at least 100° F. per minute. As was described in the above identified copending, incorporated patent application Ser. No. 790,439, more rapid cooling rates have a beneficial effect on properties such as stress rupture strength.

The heat treatment of the present invention is further characterized by a progressive combination of aging steps after solutioning. The first or primary age is conducted in a temperature range of about 2025°–2075° F. in a non-oxidizing atmosphere, for example for about 1–10 hours, to improve ductility and stress rupture strength of the article. After the first solutioning, it is preferred that cooling, for example to the range of about 1950°–2000° F., be at a rate of about 75° F. per hour prior to further cooling. A second aging step, at a temperature lower than the first aging, for example in the range of about 1950°–2000° F. for about 4–12 hours, generally about 4–8 hours, enables growth of the gamma prime to improve ductility. As can be seen from the data of Table V, this unique progressive combination of heating steps results in a structure of improved mechanical properties and enables heat treatment of castings having thin walls without detrimental affect on such walls.

After the above aging steps, a final aging step generally is beneficial, for example, in the range of about 1625°-1675° F. for about 2-10 hours, typically about 4-8 hours.

The heat treatment of the present invention, in connection with the DS cast article utilizing the alloy associated with this invention maximizes longitudinal stress rupture strength while retaining acceptable transverse strength and ductility. This is due, at least in part, to the increased solutioning of the gamma prime at a relatively higher temperature, Introduction of a primary or first aging in the range of about 2025°-2075° F. followed by a relatively slow cool (for example, about 1 hour) to a temperature in the range of about 1950°-2000° F. before further cooling resulted in a further improvement in longitudinal stress rupture life coupled with improved transverse stress rupture properties.

The combination of alloy selection, casting practice, and heat treatment, according to the present invention, enables provision of an improved DS columnar grain article including a thin wall of less than about 0.035 inch substantially free of cracks. In the form of a gas turbine engine turbine blade, which has a radial centerline, the grain boundaries and primary dendritic orientation is approximately straight and parallel. In addition, it is preferred in such an article, and is capable through this invention, that any emergent grain from the airfoil of such a blade intersect the airfoil leading edge or trailing edge at an angle no greater than 15° with the edge and that all other grain boundaries and primary dendrites are within 15° of the radial centerline.

As a result of evaluations of the type described above, it was recognized that the article and heat treatment of the present invention can be used with a particular alloy range. A specific alloy range is particularly unique in the combination with the heat treatment. The following Table VII identified such useful and the novel specific alloy range.

TABLE VII

ALLOY COMPOSITION FORMS
Wt %, balance Ni and incidental impurities

| | RANGES | | |
|---|---|---|---|
| ELEMENTS | BROAD | PREFERRED | SPECIFIC |
| C | 0.1-0.15 | 0.1-0.15 | 0.1-0.14 |
| Hf | 0.3-2 | 1-2 | 1.2-1.7 |
| Co | 11-14 | 11-13 | 11.7-12.3 |
| Ta | 5-9 | 6-7 | 6.2-6.5 |
| V | no more than 1 | less than 1 | 0-0.1 |
| Zr | less than .05 | 0-.03 | 0-0.03 |
| Cr | 5-10 | 6-7 | 6.6-7 |
| Mo | 0.5-3 | 1-2 | 1.3-1.7 |
| W | 4-7 | 4.5-5.5 | 4.7-5.1 |
| Ti | no more than 1 | less than 1 | 0-0.02 |
| Al | 5-7 | 5.5-6.5 | 6-6.3 |
| Re | 1.5-4 | 2.5-3.5 | 2.6-3 |
| B | .005-.03 | .01-.02 | .01-.02 |
| Cb | 0-1.5 | 0-0.5 | 0-0.1 |
| Y | 0-0.5 | 0-0.5 | 0-0.2 |

This invention has been described in connection with specific examples and embodiments. However, it will be understood by those skilled in the metallurgical arts involved that the invention is capable of a variety of other forms and embodiments within the scope of the appended claims.

What is claimed is:

1. A nickel base superalloy consisting essentially of in weight percent about 0.12% carbon, about 1.5% hafnium, 12% cobalt, about 6.35% tantalum, about 6.8% chromium, about 1.5% molybdenum, about 4.9% tungsten, about 6.15% aluminum, about 2.8% rhenium, about 0.015% boron, the substantial absence of zirconium, the substantial absence of titanium, the substantial absence of vanadium and the balance nickel and incidental impurities.

2. An article the alloy of of claim 1 having an internal cavity within an outside article surface, the cavity including an integral cast wall, substantially free of cracks, and a wall thickness of less than about 0.035 inch.

3. The cast article of claim 2 in which the internal cavity is separated from the outside surface by an article wall across a thickness of less than about 0.035 inch.

4. The cast article of claim 2 in the form of a turbine blading member having a radial centerline and including an airfoil having a leading edge and a trailing edge in which:

grain boundaries and primary dendritic orientation is approximately straight and parallel; and, any emergent grain which intersects the airfoil leading or trailing edge forms an angle no greater than 15° with the edge, and all other grain boundaries and primary dendrites are within 15° of the radial centerline.

5. The article of claim 1 wherein the article is a gas turbine engine airfoil.

6. In a method of heat treating a cast nickel base alloy article made of an alloy consisting essentially of, in weight percent, 0.1-0.15 C, 0.3-2 Hf, 11-14 Co, 5-9 Ta, less than 0.05 Zr and the substantial absence of V and Ti at no more than about 1 each, 5-10 Cr, 0.5-3 Mo, 4-7 W, 5-7 Al, 1.5-4 Re, 0.005-0.03 B, up to 1.5 Cb, up to 0.5 Y and the balance Ni and incidental impurities, the steps of:

(a) heating at a solutioning temperature in a non-oxidizing atmosphere for a time sufficient to solution at least 90% of the gamma-gamma prime eutectic and coarse secondary gamma prime and so that there is no more than about 4% incipient melting, and then cooling in the atmosphere to a temperature in the range of about 2025°-2075° F.;

(b) heating at a first aging temperature in the range of about 2025°-2075° F. in a non-oxidizing atmosphere for about 1-10 hours and then cooling in the atmosphere to a temperature in the range of about 1950°-2000° F.; and (c) heating at a second aging temperature lower than the first aging temperature in the range of about 1950°-2000° F. for about 4-12 hours.

7. The method of claim 6 including a third aging step of:

(d) heating at a temperature range of about 1625°-1675° F. for about 2-10 hours.

8. The method of claim 6 in which the solutioning temperature is in the range of 2275°-2360° F. and the heating time is at least about 30 minutes.

9. The method of claim 8 including a third aging step of:

(d) heating at a temperature range of about 1625°-1675° F. for about 2-10 hours.

10. In a method of making a cast columnar grain nickel base superalloy article of outstanding elevated temperature oxidation resistance, the article having an internal cavity including an integral cast wall of a wall thickness of less than about 0.035 inch, the steps of:

(a) precision casting the article from an alloy consisting essentially of, in weight percent, 0.1–0.15 C, 0.3–2 Hf, 11–14 Co, 5–9 Ta, less than 0.05 Zr and the substantial absence of V and Ti at no more than about 1 each, 5–10 Cr, 0.5–3 Mo, 4–7 W, 5–7 Al, 1.5–4 Re, 0.005–0.03 B, up to 1.5 Cb, up to 0.5 Y and the balance Ni and incidental impurities, with the cast wall integral with the casting by columnar multigrain directional solidification casting; and (b) heat treating the cast article in accordance with claim 6.

11. The method for making a cast columnar grain nickel base superalloy gas turbine engine turbine blading member of outstanding elevated temperature oxidation resistance, the article having at least one internal cavity including an integral cast wall of a wall thickness less than about 0.035 inch comprising the steps of:

(a) providing a superalloy consisting essentially of, in weight percent, 0.1–0.14 C, 1.2–1.7 Hf, 11.7–12.3 Co, 6.2–6.5 Ta, up to 0.1 V, up to 0.03 Zr, 6.6–7 Cr, 1.3–1.7 Mo, 4.7–5.1 W, no more than about 0.02 Ti, 6–6.3 Al, 2.6–3 Re, 0.01–0.02 B, up to 0.1 Cb, up to 0.2 Y, and the balance Ni and incidental impurities;

(b) precision casting said superalloy to provide an article having at least one internal cavity including an integral cast wall of a wall thickness of less than about 0.035 inch; and (c) heat treating said cast article in accordance with claim 8.

* * * * *